US006561142B2

(12) United States Patent
Moteki et al.

(10) Patent No.: US 6,561,142 B2
(45) Date of Patent: May 13, 2003

(54) CRANK MECHANISM OF RECIPROCATING INTERNAL COMBUSTION ENGINE OF MULTI-LINK TYPE

(75) Inventors: Katsuya Moteki, Tokyo (JP); Shunichi Aoyama, Kanagawa (JP); Ryousuke Hiyoshi, Kanagawa (JP); Hiroya Fujimoto, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/006,622

(22) Filed: Dec. 10, 2001

(65) Prior Publication Data

US 2002/0073944 A1 Jun. 20, 2002

(30) Foreign Application Priority Data

Dec. 15, 2000 (JP) ..... 2000-381435

(51) Int. Cl.[7] ..... F01B 30/14
(52) U.S. Cl. ..... 123/48 B; 123/197.3
(58) Field of Search ..... 123/197.3, 197.4, 123/48 B

(56) References Cited

U.S. PATENT DOCUMENTS 4,475,495 A * 10/1984 Lydell ..... 123/197.3
4,517,931 A * 5/1985 Nelson ..... 123/197.4
4,890,588 A * 1/1990 Tillman ..... 123/197.3
6,202,622 B1 * 3/2001 Raquiza, Jr. ..... 123/197.4
6,352,057 B1 * 3/2002 Drecq ..... 123/197.3
2001/0017112 A1 8/2001 Moteki et al. ..... 123/78 R

FOREIGN PATENT DOCUMENTS

JP 2000-73804 3/2000

OTHER PUBLICATIONS

U.S. patent application Ser. No. 09/899,038, Moteki et al., filed Jul. 6, 2001.
U.S. patent application Ser. No. 09/961,240, Moteki, filed Sep. 25, 2001.
Von Christoph Bollig et al. "Kurbeltrieb für variable Verdichtung", MTZ Motortechnische Zeitschrift 58 (1997), pp. 706–711.

* cited by examiner

*Primary Examiner*—Noah P. Kamen
*Assistant Examiner*—Jason Benton
(74) *Attorney, Agent, or Firm*—Foley & Lardner

(57) ABSTRACT

A paired counterweights of a crankshaft have projected inner surfaces which protrude toward each other defining a given space therebetween. A plurality of links are arranged to convert a reciprocating motion of a piston to a rotational motion of the crankshaft. One of the links is pivotally connected to other links through link connecting portions and swingably disposed on a crank pin of the crankshaft so that upon rotation of the crankshaft, a peripheral portion of the link passes through the given space. At least one of the link connecting portions is placed within an imaginary circle which would be described by a radially innermost part of the projected inner surfaces of the paired counterweights when the paired counterweights turn about an axis of the crank pin.

20 Claims, 15 Drawing Sheets

CRANK MECHANISM OF RECIPROCATING INTERNAL COMBUSTION ENGINE OF MULTI-LINK TYPE

BACKGROUND OF INVENTION

1. Field of Invention

The present invention relates in general to reciprocating internal combustion engines of a type that is capable of varying a compression ratio during operation thereof. Particularly, the present invention relates to the reciprocating internal combustion engines of a multi-link type wherein each piston is connected to a crankshaft through a plurality of links, and more particularly to a crank mechanism of such internal combustion engines.

2. Description of Related Art

The paper "MTZ Motortechnische Zeitschrift 58" issued in 1997 in Germany shows in pages 706 to 711 an internal combustion engine of the above-mentioned multi-link type. In addition, Laid-open Japanese Patent Application (Tokkai) 2000-73804 shows such engine. In order to clarify the task of the present invention, a crank mechanism employed in the engine of 2000-73804 will be briefly described with reference to FIG. 16.

In FIG. 16, denoted by numeral 51 is a cylinder of the engine. A piston 3 is slidably received in the cylinder 3. An upper link 52 extends downward from a piston pin 5 of the piston 3. Denoted by numeral 56 is a lower link which is pivotally disposed on a crank pin 55 of a crankshaft 54. The crankshaft 54 comprises a plurality of paired counterweights 60. Each pair of the counterweights 60 have the crank pin 55 at diametrically opposed ends (viz., crank webs) thereof. The lower link 56 has one arm pivotally connected to a lower end of the upper link 52 through a first connecting pin 53. The lower link 56 has another arm pivotally connected to a lower end of a control link 38 through a second connecting pin 57. An upper end of the control link 38 is connected to an eccentric cam 59, so that a rotational movement of the eccentric cam 59 changes the position of the control link 38. With this changing, the top dead center (TDC) of the piston 3 changes and thus compression ratio of the engine changes.

SUMMARY OF INVENTION

In the crank mechanism of the publication, under operation of the engine, the paired counterweights 60 are rotated about an axis of the crankshaft 54 within a zone defined between the first and second connecting pins 53 and 57. For achieving such rotation of the counterweights 60 without inducing interference of the first and second connecting pins 53 and 58 with the counterweights 60, it is inevitably necessary to cause the lower link 56 to have an elongated and bulky structure, as shown, which however brings about a bulky structure of the entire construction of the crank mechanism. Furthermore, in the crank mechanism of the publication, due to its inevitable construction, it is difficult to provide the first and second connecting pins 53 and 57 with a satisfied bearing capacity.

It is therefore an object of the present invention to provide a crank mechanism of a reciprocating internal combustion engine of a multi-link type, which can provide the connecting pins with a satisfied bearing capacity irrespective of a compact construction of the crank mechanism.

Another object of the present invention is to provide a crank mechanism of such reciprocating internal combustion engine, which can provide the connecting pins with a satisfied bearing capacity and provide the counterweights with a satisfied inertial moment.

According to a first aspect of the present invention, there is provided a crank mechanism of a reciprocating internal combustion engine having. The crank mechanism comprises a crankshaft including paired crank webs with first end portions connected through a crank pin, and paired counterweights integral with second end portions of the paired crank webs, the paired counterweights having projected inner surfaces which protrude toward each other defining a given space therebetween, and a link mechanism including a plurality of links which are arranged to convert a reciprocating motion of the piston to a rotational motion of the crankshaft, a given one of the links being pivotally connected to other links through link connecting portions and swingably disposed on the crank pin so that upon rotation of the crankshaft, a peripheral portion of the given link passes through the given space, wherein at least one of the link connecting portions is placed within an imaginary circle which would be described as being centered about an axis of said crank pin and having a radius substantially equal to the distance between the radially innermost part of the projected inner surfaces of the paired counterweights and the center of the crank pin.

According to a second aspect of the present invention, there is provided a crank mechanism of a reciprocating internal combustion engine having a piston. The crank mechanism comprises a crankshaft including paired crank webs with first end portions connected through a crank pin, and paired counterweights integral with second end portions of the paired crank webs, the paired crank webs having mutually facing surfaces which define therebetween a given space; a link mechanism including a plurality of links which are arranged to convert a reciprocating motion of the piston to a rotational motion of the crankshaft, a given one of the links being pivotally connected to other links through link connecting portions and swingably disposed on the crank pin so that upon rotation of the crankshaft, a peripheral portion of the given link passes through the given space; and recesses respectively formed in the mutually facing surfaces of the paired crank webs, the recesses being positioned and sized to permit at least one of the link connecting portions to pass therebetween upon swinging of the given link about an axis of the crank pin.

DETAILED DESCRIPTION OF EMBODIMENTS

In the following, embodiments of the present invention will be described with reference to the accompanying drawings.

For ease of understanding, various directional terms, such as, right, left, upper, lower, rightward, leftward and the like will appear in the description. However, such terms are to be understood with respect to only drawing or drawings on which the corresponding part is illustrated.

Referring to FIG. 1 to FIGS. 8A and 8B, there is shown a crank mechanism 100 which is a first embodiment of the present invention.

Figure 1:
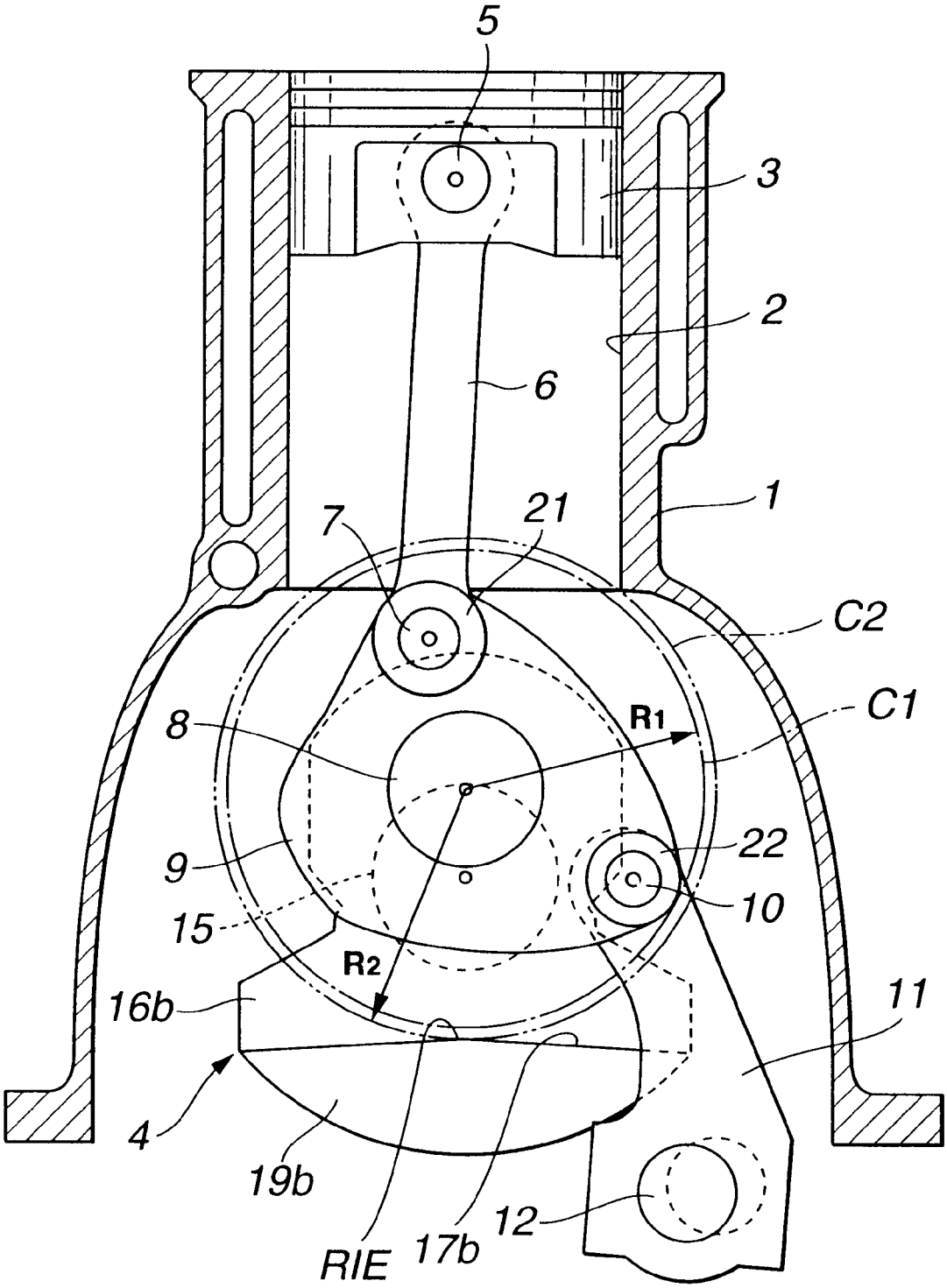
FIG. 1 is a sectional view of an internal combustion engine to which a crank mechanism of a first embodiment of the present invention is practically applied.

In FIG. 1, a reciprocating internal combustion engine is shown to which the crank mechanism 100 of the first embodiment is practically applied. The engine generally comprises a cylinder block 1 having a plurality of cylinders 2 which are juxtaposed. Each cylinder 2 has a piston 3 slidably disposed therein. A crankshaft 4 extends axially below the cluster of the pistons 3, which is rotatably held by the cylinder block 1.

An upper link 6 extends downward from each of the pistons 3. That is, the upper link 6 has an upper end pivotally connected to the piston 3 through a piston pin 5. The upper link 6 has a lower end pivotally connected to a lower link 9 through a first connecting pin 7. The lower link 9 is swingably disposed on a crank pin 8 of the crankshaft 4 and has one end to which an upper end of a control link 11 is pivotally connected through a second connecting pin 10. A lower end of the control link 11 is movably supported by a support member of the engine through an eccentric cam 12. Although not shown in the drawing, the eccentric cam 12 is rotatably held by a bearing member fixed to the support member. That is, when rotated, the eccentric cam 12 varies the position of the control link 11 relative to the support member and thus varies a top-dead-center (TDC) of the piston 3 thereby varying the compression ratio of the engine.

Figure 2:
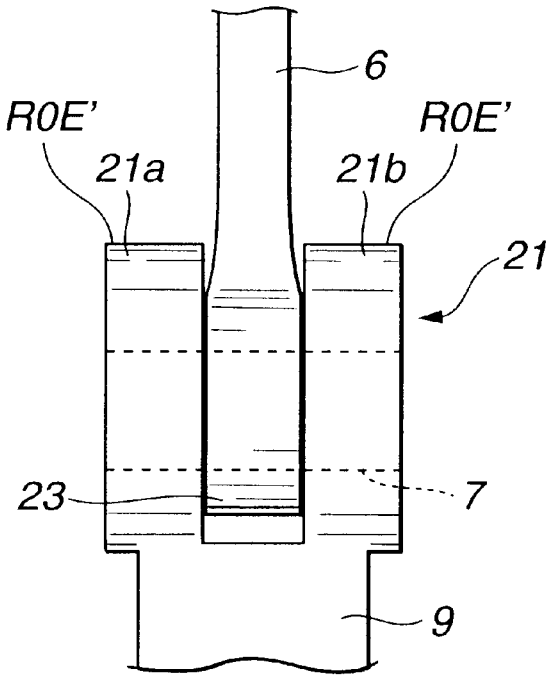
FIG. 2 is a partial view of the crank mechanism of the first embodiment, showing a portion where an upper link and a lower link are pivotally connected.

As is seen from FIG. 2, the lower link 9 comprises a first forked portion 21 having two spaced support arms 21*a* and 21*b*. These support arms 21*a* and 21*b* have flat inner surfaces and are respectively formed with cylindrical bores (no numerals) which are aligned. As shown, the lower end of the upper link 6 constitutes an arm 23 which has flat outer surfaces and is formed with a cylindrical bore (no numeral). The arm 23 is coaxially received between the two spaced support arms 21*a* and 21*b*, and the first connecting pin 7 is received in the aligned cylindrical bores of the coaxially arranged arms 21*a*, 23 and 21*b*, as shown.

Figure 3:
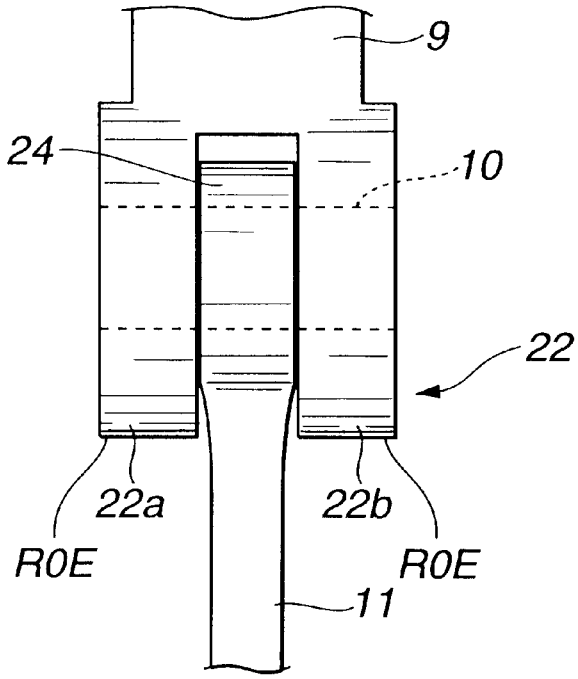
FIG. 3 is a partial view of the crank mechanism of the first embodiment, showing a portion where the lower link and a control link are pivotally connected.

Like this, as is seen from FIG. 3, the lower link 9 further comprises a second forked portion 22 having two spaced support arms 22*a* and 22*b*. These support arms 22*a* and 22*b* have flat inner surface and are respectively formed with cylindrical bores (no numerals) which are aligned. As shown, the upper end of the control link 11 constitutes an arm 24 which has flat outer surfaces and is formed with a cylindrical bore (no numeral). The arm 24 is coaxially received between the two spaced support arms 22*a* and 22*b*, and the second connecting pin 10 is received in the aligned cylindrical bores of the coaxially arranged arms 22*a*, 24 and 22*b*, as shown.

As is seen from FIGS. 2 and 3, the first and second forked portions 21 and 22 have each a thickness (viz., a thickness measured in an axial direction of the engine) greater than that of a major central portion of the lower link 9.

Figure 4:
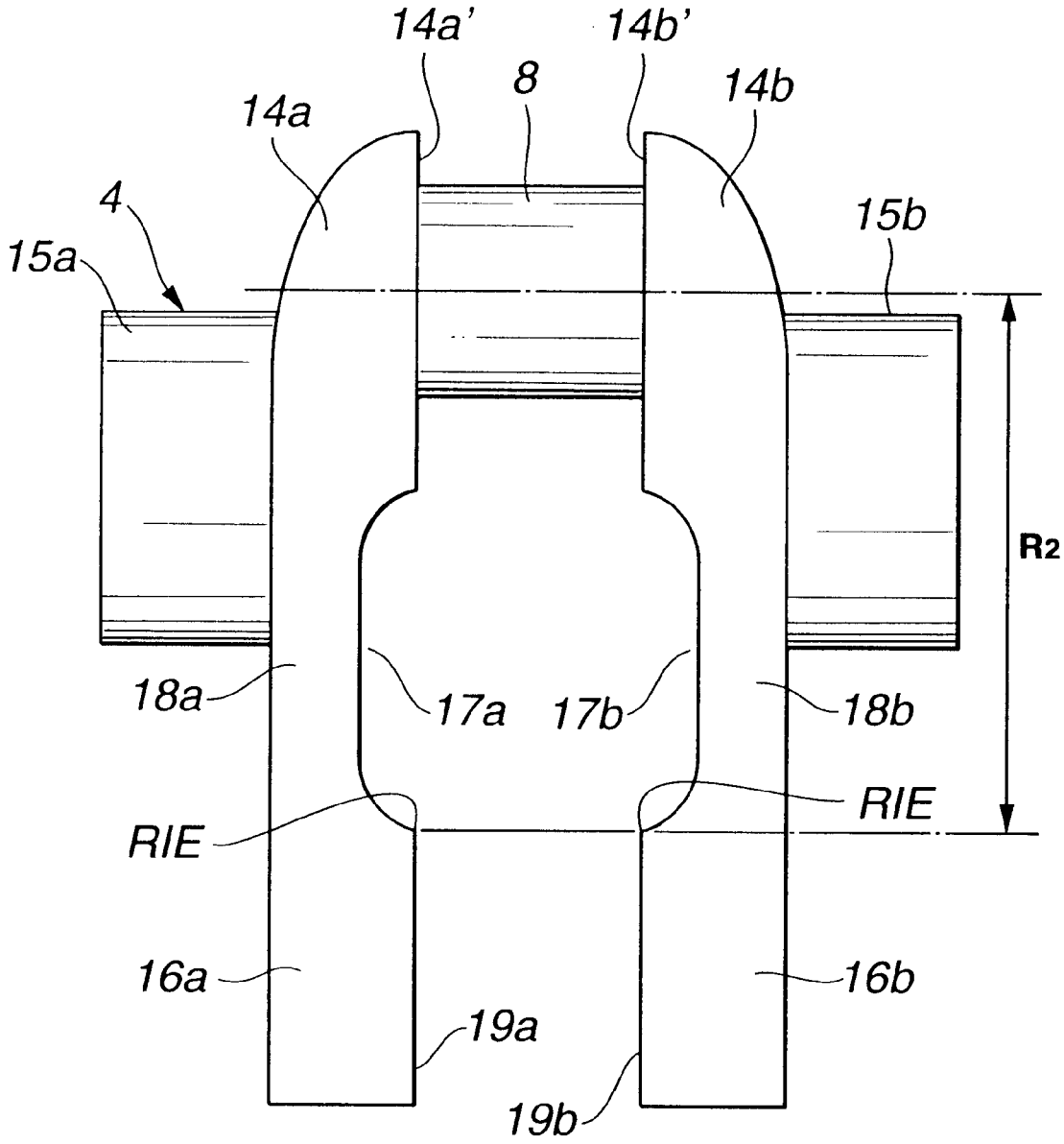
FIG. 4 is a front partial view of the crank mechanism of the first embodiment, showing an essential portion of a crankshaft.

As is seen from FIGS. 1 and 4, the crankshaft 4 comprises a plurality of units, each including aligned crank journals 15*a* and 15*b* which are connected through paired crank webs 14*a* and 14*b* and a crank pin 8. The crank pin 8 extends between the paired crank webs 14*a* and 14*b*. Each crank web 14*a* or 14*b* has, at an end radially opposite to the crank pin 8, a counterweight 16*a* or 16*b* integral therewith. As is seen from FIG. 1, the counterweight 16*a* or 16*b* is generally sectorial in shape when viewed from an axial direction of the engine.

Referring back to FIG. 4, the counterweights 16*a* and 16*b* respectively have projected inner surfaces 19*a* and 19*b* which protrude toward each other. The crank webs 14*a* and 14*b* are formed at generally middle portions thereof with respective recesses 17*a* and 17*b* which face each other. These recesses 17*a* and 17*b* have mutually facing bottom surfaces respectively. As shown, each recess 17*a* or 17*b* has smoothly curved side walls. Due to provision of the recesses 17*a* and 17*b*, each crank web 14*a* or 14*b* has a thinner portion 18*a* or 18*b* at the middle portion. That is, each recess 17*a* or 17*b* of the crank web 14*a* or 14*b* is provided between the corresponding projected inner surface 19*a* or 19*b* and a portion of the crank web 14*a* or 14*b* to which the crank pin 8 is connected.

As is seen from FIG. 4, the projected inner surfaces 19*a* and 19*b* are substantially flush with mutually facing surfaces 14*a*' and 14*b*' of the crank webs 14*a* and 14*b* between which the crank pin 8 extends. In other words, the projected inner surface 19*a* or 19*b* and the surface 14*a*' or 14*b*' are provided at substantially same positions with respect to an axial direction of the crankshaft 4.

In FIG. 1, denoted by reference C1 is a first imaginary circle which would be described by a radially outermost end "ROE" (see FIG. 3) of the support arm portion 22*a* or 22*b* of the lower link 9 if the lower link 9 turns about the axis of the crank pin 8. The first imaginary circle C1 has a radius R1. While, denoted by reference C2 is a second imaginary circle which would be described by a radially innermost end "RIE" (see FIG. 4) of the projected inner surface 19*a* or 19*b* of the counterweight 16*a* or 16*b* when the paired counterweights 16*a* and 16*b* turn about the axis of the crank pin 8. The second imaginary circle C2 has a radius R2.

As shown, the radius R1 of the first circular C1 is smaller than the radius R2 of the second circle C2. With this dimensional relation, the lower link 9 can rotate smoothly within the second circle C2 without inducing undesired interference with the projected inner surfaces 19*a* and 19*b* of the counterweights 16*a* and 16*b*. This will be well understood from the following description directed to FIG. 7.

Figure 7:
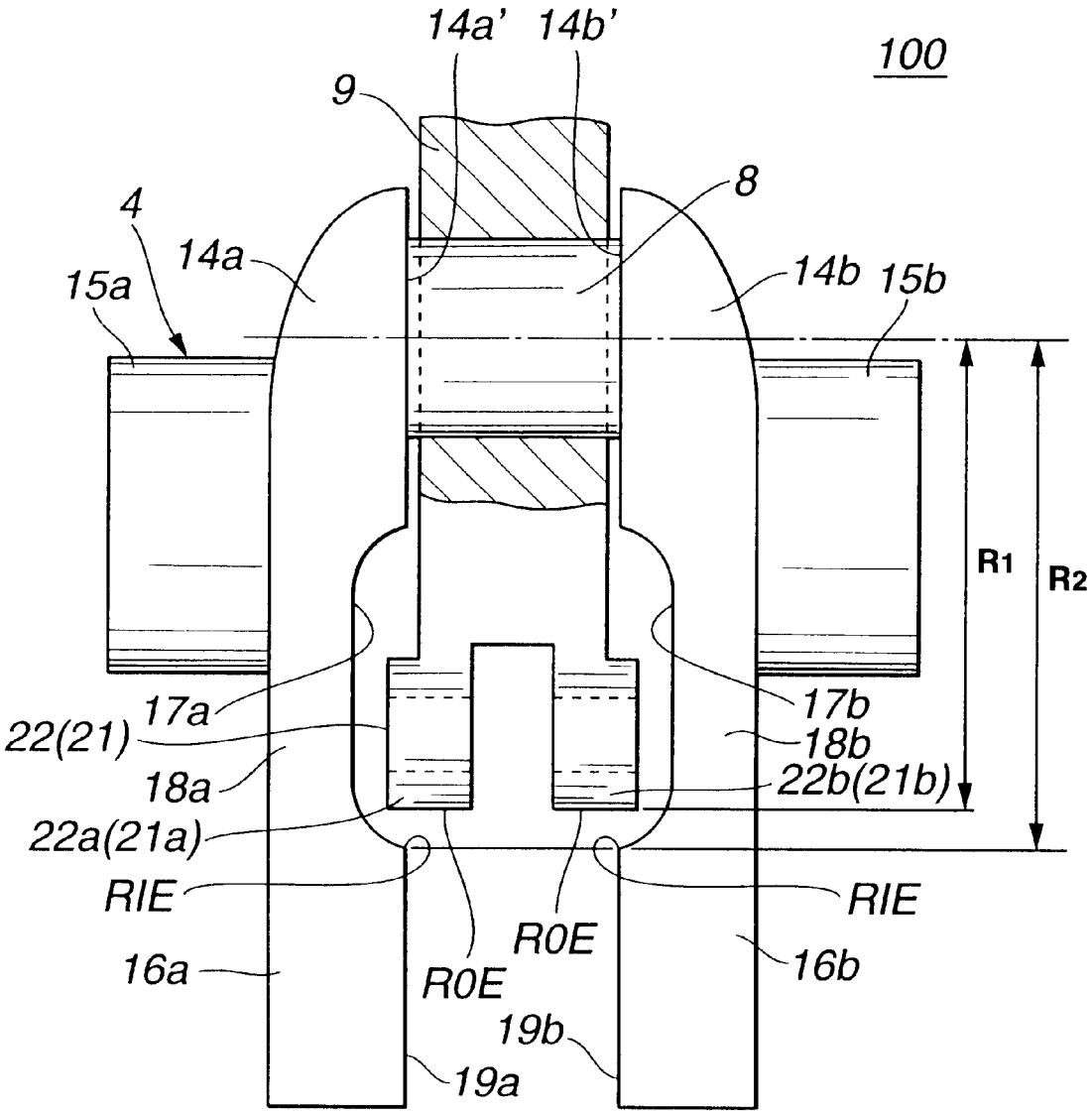
FIG. 7 is a view similar to FIG. 4, but showing the essential portion of the crankshaft being incorporated with the lower link.

FIG. 7 shows the lower link 9 swingably disposed on the crank pin 8 which extends between the crank webs 14*a* and 14*b*. As is seen from this drawing, the radius RI is a distance between the axis of the crank pin 8 and the radially outermost end "ROE" of each of the support arms 22*a* and 22*b* of the second forked portion 22 of the lower link 9. It is now to be noted that, in the first embodiment 100, the radius R1 is also the distance between the axis of the crank pin 8 and a radially outermost end "ROE" (see FIG. 2) of each of the support arms 21*a* and 21*b* of the first forked portion 21 of the lower link 9. The radius R2 is a distance between the axis of the crank pin 8 and the radially innermost end "RIE" of each of the projected inner surfaces 19*a* and 19*b* of the counterweights 16*a* and 16*b*.

Furthermore, as is seen from FIG. 7, an axial dimension (or thickness) of each of first and second forked portion 21 or 22 is greater than a distance between the projected inner surfaces 19*a* and 19*b* of the counterweights 16*a* and 16*b* but smaller than a distance between the mutually facing bottom surfaces of the recesses 17*a* and 17*b*.

With the above-mentioned positional and dimensional relation, the first and second forked portions 21 and 22 of the lower link 9 are suppressed from interfering with the counterweights 16*a* and 16*b* upon swinging of the lower link 9 about the crank pin 8 under operation of the engine. This movement of the first and second forked portions 21 and 22 of the lower link 9 will be much clearly understood from the following description directed to FIGS. 5 and 6.

Figure 5:
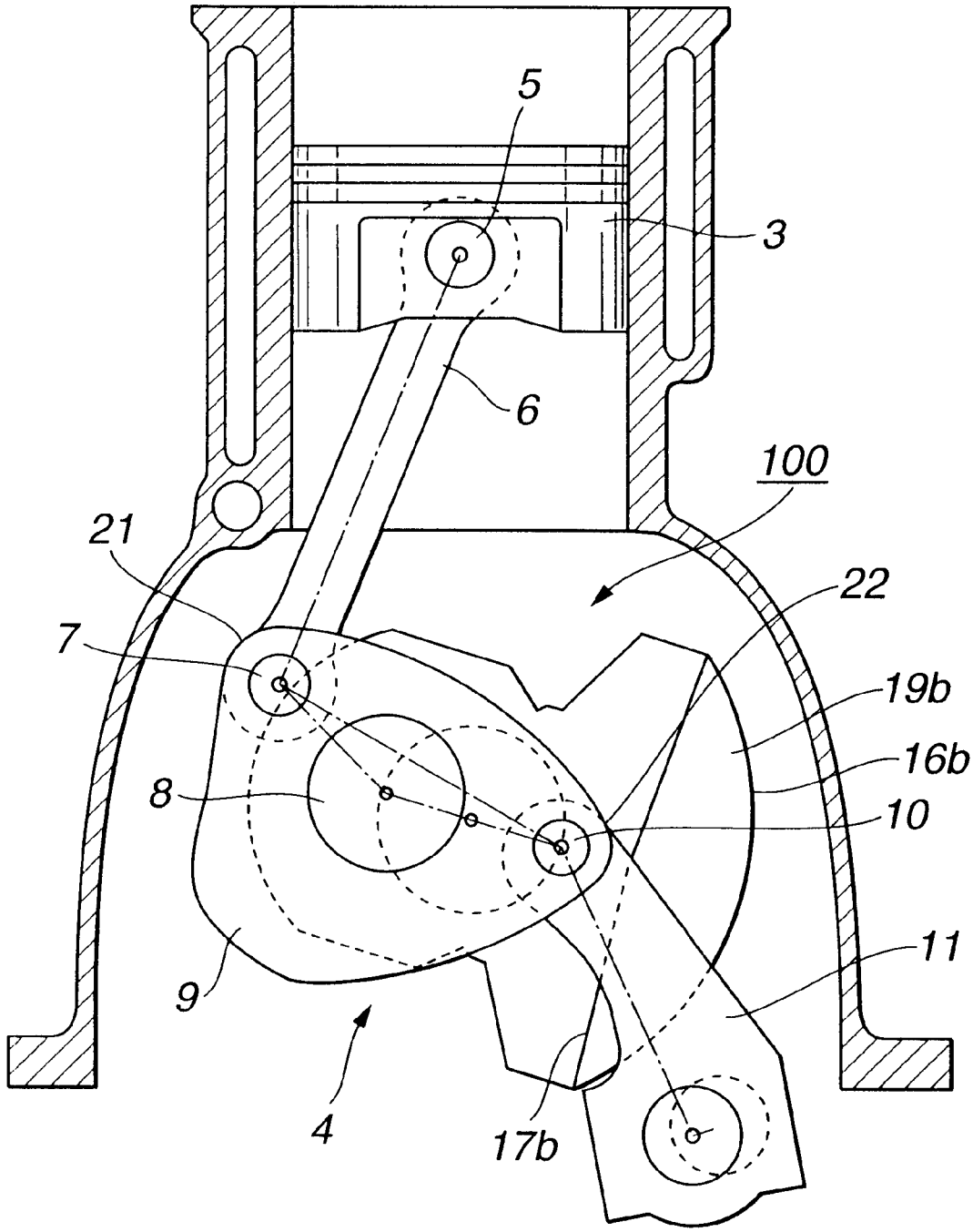
FIG. 5 is a view similar to FIG. 1, but showing a condition wherein a counterweight passes by a second connecting pin.
Figure 6:
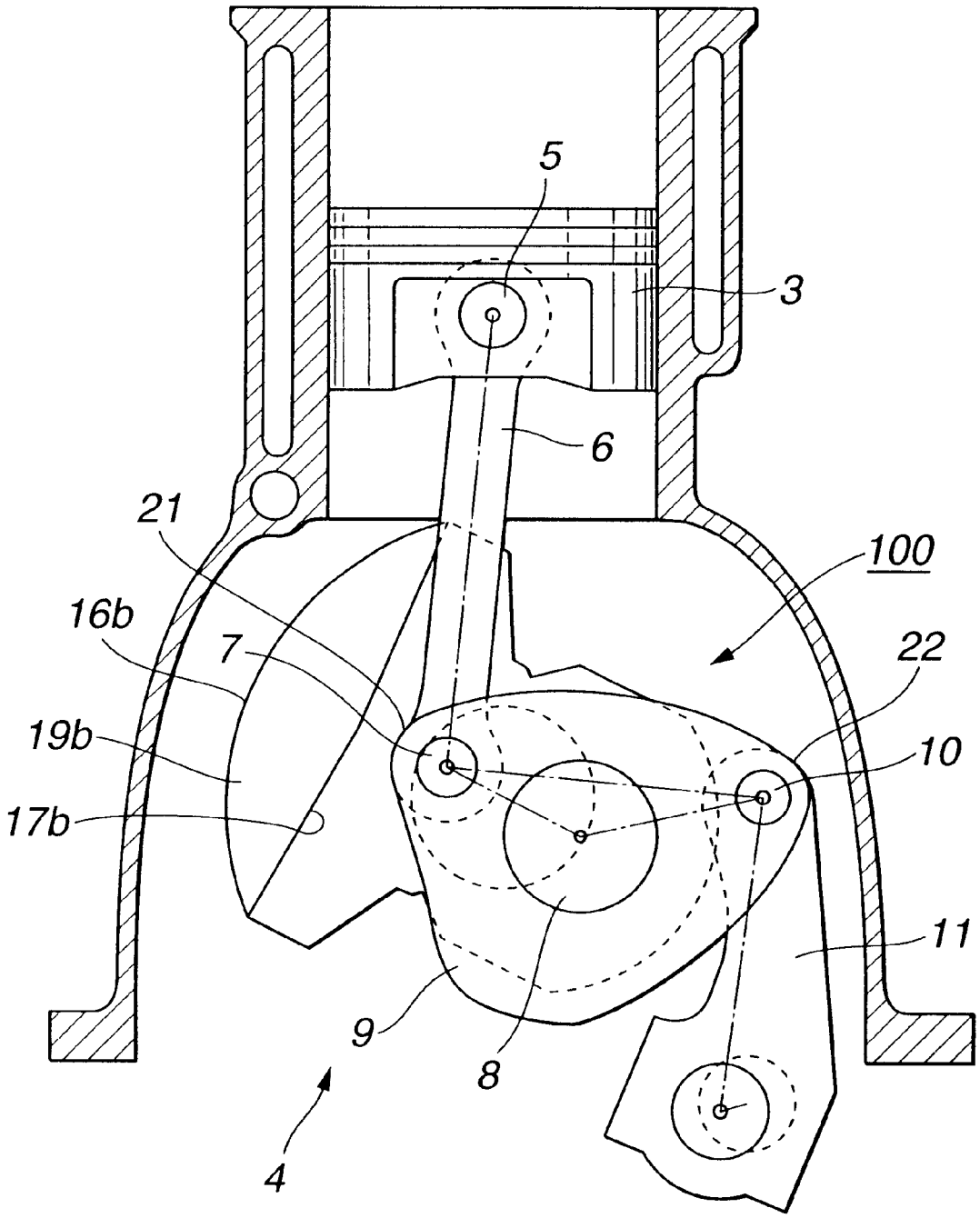
FIG. 6 is a view similar to FIG. 5, but showing another condition wherein the counterweight passes by a first connecting pin.

FIG. 5 shows an instantaneous state of the crank mechanism 100 wherein the projected inner surface 19*b* (or 19*a*) of the counterweight 16*b* (or 16*a*) passes by the second forked portion 22 of the lower link 9, and FIG. 6 shows another instantaneous state of the crank mechanism 100 wherein the projected inner surface 19*b* (or 19*a*) passes by the first forked portion 21 of the lower link 9. As has been mentioned hereinabove, the lower link 9 is swingably held by the crank pin 8, and thus, as is seen from these drawings FIGS. 5 and 6, under operation of the engine, that is, under rotation of the crankshaft 4, the lower link 9 and the counterweight 16*b* (or 16*a*) make a relative rotation about the crank pin 8. For the reasons as have mentioned hereinabove, during this relative rotation between the lower link 9 and the counterweight 16*b* (or 16*a*), these parts 9 and 16*b* (or 16*a*) are suppressed from making the undesirable mutual interference.

Figure 8A:
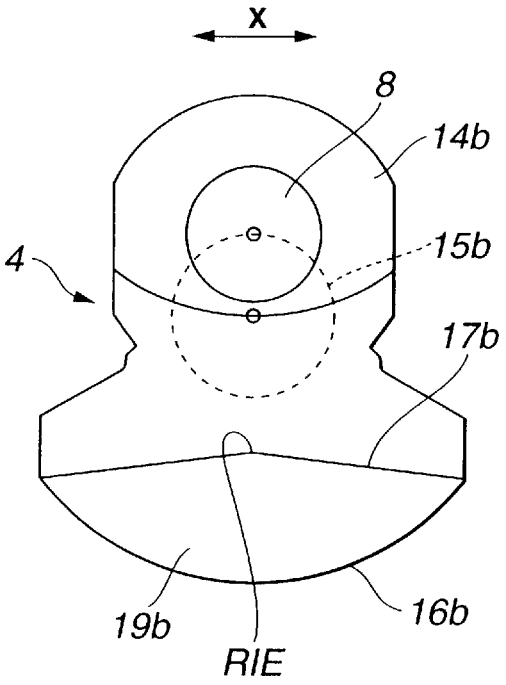
FIG. 8A is a sectional view taken along the line VIII—VIII of FIG. 8B.
Figure 8B:
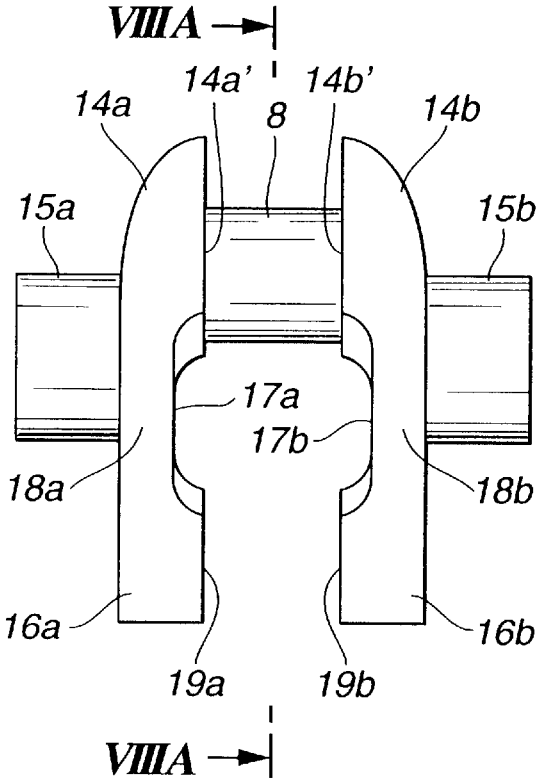
FIG. 8B is a front view of a portion of the crankshaft where paired counterweights are arranged.

Referring to FIGS. 8A and 8B, particularly FIG. 8B, there is shown in detail one unit of the countershaft 4, which comprises the aligned crank journals 15*a* and 15*b*, the paired crank webs 14*a* and 14*b* and the crank pin 8.

As is easily seen from FIG. 8A which is a sectional view taken along the line VIIIA—VIIIA of FIG. 8B, the recess 17*b* or 17*a* extends in a direction "x" perpendicular to the axis of the crankshaft 4. The upper wall of the recess 17*b* or 17*a* is smoothly curved upward and the lower wall of the same comprises two slightly inclined straight walls which are joined at the radially innermost end "RIE". As shown, the recess 17*b* or 17*a* is shaped generally like a butterfly. That is, the recess 17*b* or 17*a* is so shaped that with increase of distance from a middle portion where the end "RIE" is provided, the width of the recess 17*b* or 17*a* gradually increases.

In the following, other advantages possessed by the above-mentioned crank mechanism 100 of the first embodiment will be described.

Due to provision of the recesses 17*a* and 17*b* in the mutually facing surfaces of the crank webs 14*a* and 14*b*, the first and second forked portions 21 and 22 of the lower link 9 can be enlarged in size, as is seen from FIG. 7. More specifically, the first and second forked portions 21 and 22 and the corresponding first and second connecting pins 7 and 10 can be increased in axial direction. This means that the bearing capacity of the first and second connecting pins 7 and 10 of such first and second forked portions 21 and 22 is increased. Furthermore, due to provision of the recesses 17*a* and 17*b*, each counterweight 16*a* or 16*b* can have a desirable thickness or desirable moment of inertia at will.

The crank mechanism 100 can be constructed compact in size. That is, as is seen from FIG. 1, the first connecting pin 7 is positioned at an opposite side with respect to the second connecting pin 10. This means that the lower link 9 functions to enlarge a displacement of the crank pin 8 which is transmitted to the first connecting pin 7. That is, the following inequality is established:

$$L/2r>1 \quad (1)$$

wherein:

L: stroke of piston 3 r: revolution radius of crank pin 8

Thus, enlarged stroke of the piston 3 is obtained even if the crank mechanism 100 is made compact in size. For achieving this inequality, the distance between the crank pin 8 and the second connecting pin 10 is made small, and thus, the radius R1 of the first imaginary circle C1 becomes small. This is advantageous for avoiding interference of the lower link 9 with the projected inner surfaces 19*a* and 19*b* of the counterweights 16*a* and 16*b*.

Due to the unique shape of the recesses 17*b* and 17*a* (see FIG. 8A) of the counterweights 16*a* and 16*b*, split molds for casting the crankshaft 4 can be easily released from the product upon completion of casting. That is, upon completion of casting, the split molds can be moved in the directions of "x".

Figure 9:
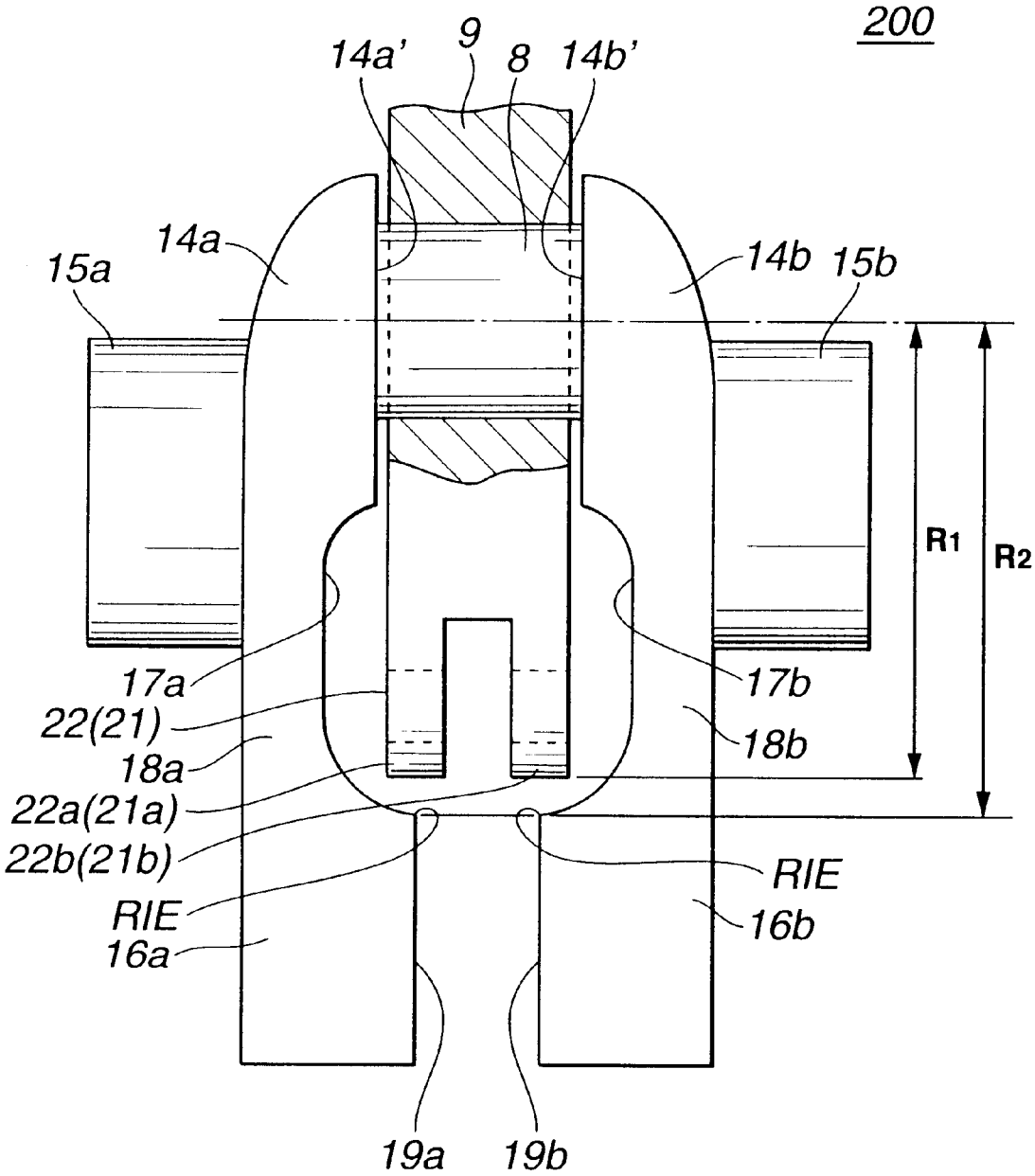
FIG. 9 is a view similar to FIG. 7, but showing an essential portion of a crank mechanism of a second embodiment of the present invention.

Referring to FIG. 9, there is shown an essential portion of a crank mechanism 200 of a second embodiment of the present invention.

Since this embodiment 200 is similar to the above-mentioned first embodiment 100, detailed explanation will be directed to only parts which are different from those of the first embodiment 100.

As is seen from FIG. 9, in this second embodiment 200, the axial dimension (or thickness) of each of the second and first forked portions 22 and 21 of the lower link 9 is equal to that of the major central portion of the lower link 9, and the distance between the projected inner surfaces 19*a* and 19*b* of the paired counterweights 16*a* and 16*b* is smaller than that between the mutually facing surfaces 14*a*' and 14*b*' of the crank webs 14*a* and 14*b*, as shown.

Of course, also in the second embodiment 200, the dimensional relation between the radius R1 and the radius R2 is the same as that in the first embodiment 100. Thus, the first and second forked portions 21 and 22 of the lower link 9 are suppressed from interfering with the paired counterweights 16*a* and 16*b* upon swinging of the lower link 9 about the crank pin 8.

Figure 10:
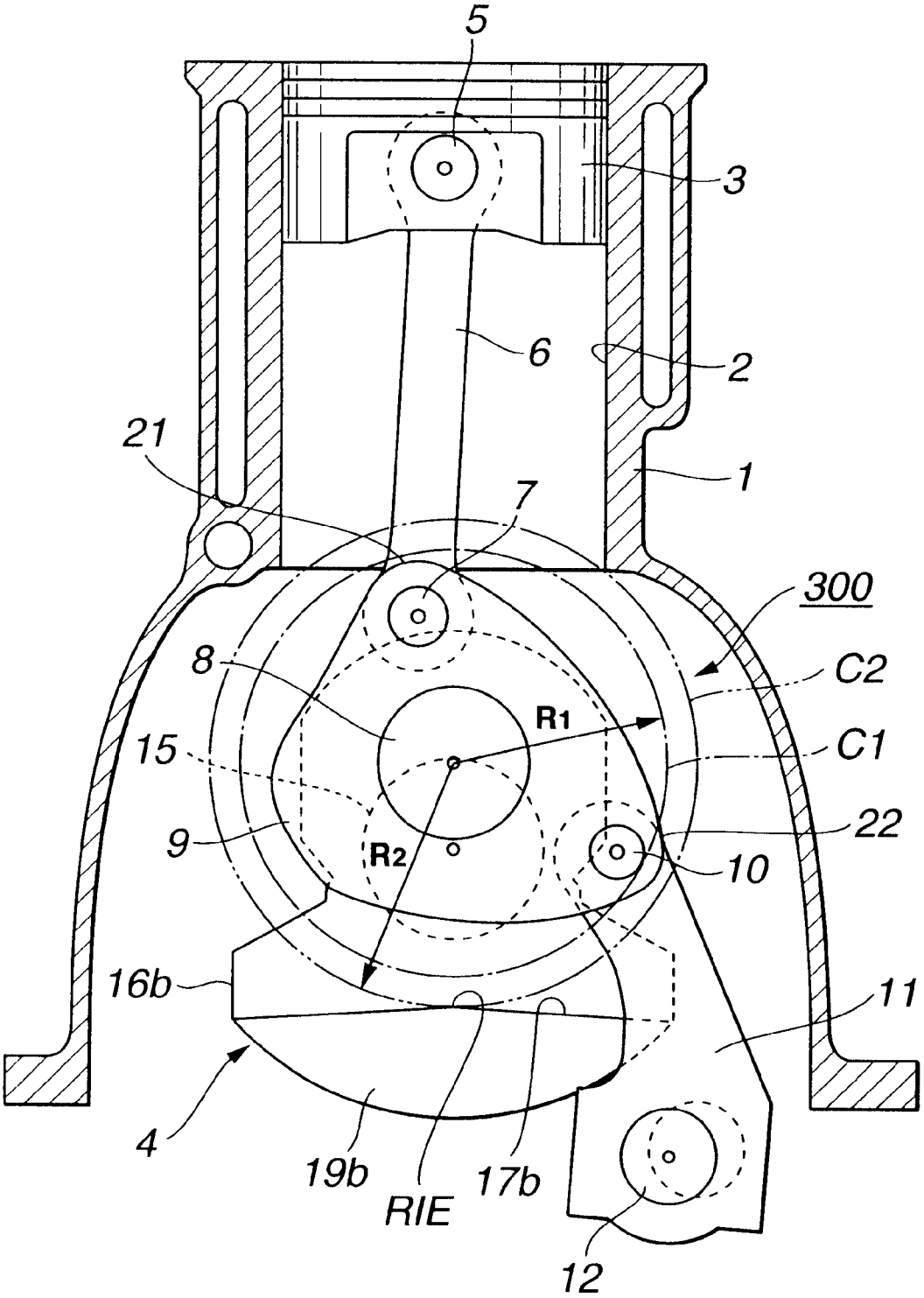
FIG. 10 is a view similar to FIG. 1, but showing a crank mechanism of a third embodiment of the present invention.
Figure 11:
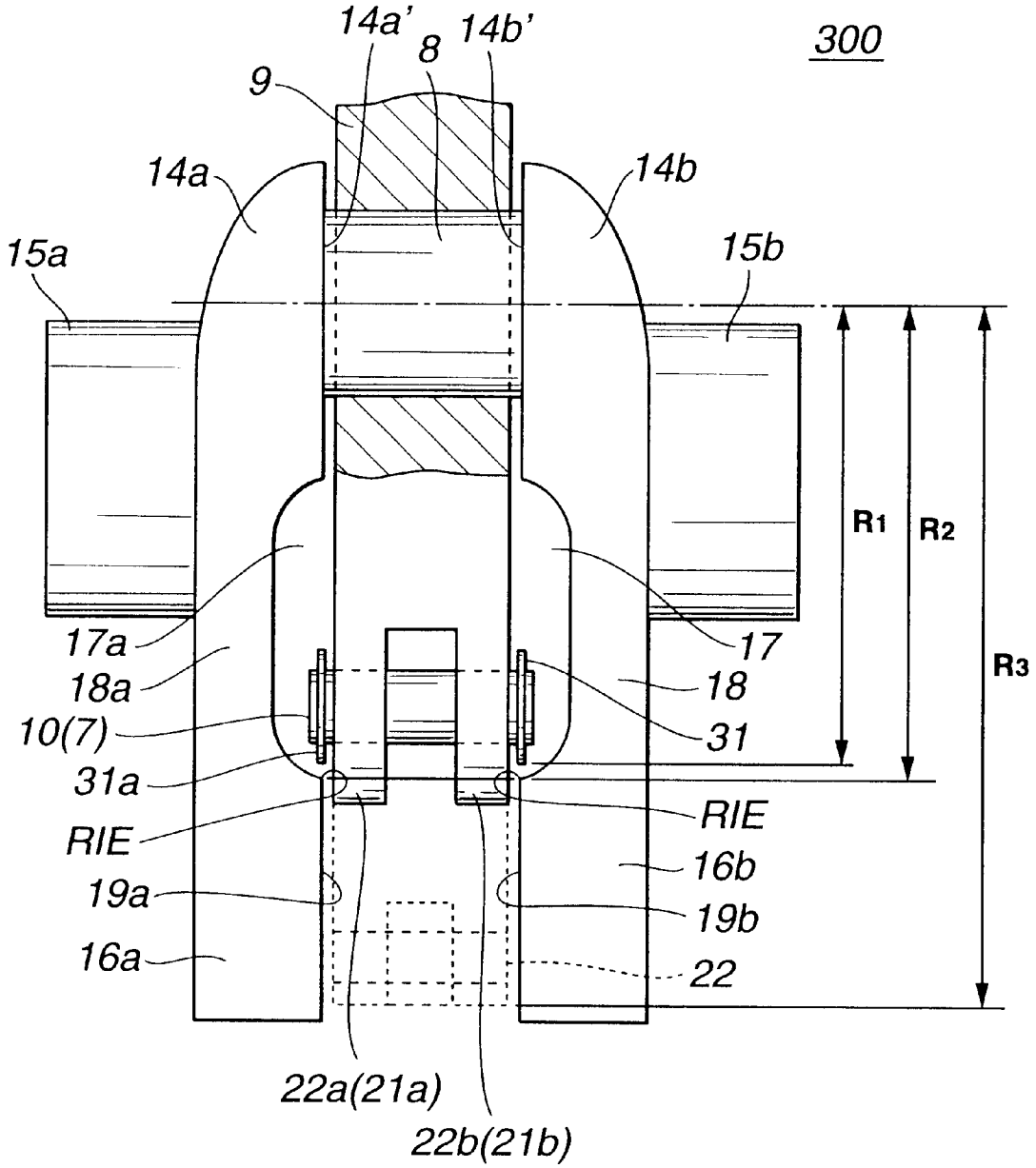
FIG. 11 is a view similar to FIG. 7, but showing an essential portion of the crank mechanism of the third embodiment of the present invention.

Referring to FIGS. 10 and 11, there is shown a crank mechanism 300 of a third embodiment of the present invention.

As is seen from FIG. 11, in this third embodiment, the axial dimension (or thickness) of each of the second and first forked portions 22 and 21 of the lower link 9 is equal to that of the major central portion of the lower link 9 and slightly smaller than the distance between the projected inner surfaces 19*a* and 19*b* of the counterweights 16*a* and 16*b*. As shown, each of the second and first connecting pins 10 and 7 incorporated with the second and first forked portions 22 and 21 has a length smaller than the distance between the mutually facing bottom surfaces of the recesses 17*a* and 17*b*. However, each connecting pin 10 or 7 has axially opposed ends projected from the support arms 22*a* and 22*b* (or, 21*a* and 21*b*). The projected ends are equipped with respective snap rings 31*a* and 31*b* for holding the connecting pin 10 or 7 in position.

As is shown in FIG. 11, in this third embodiment, the radius R1 of the first imaginary circle C1 represents a distance between the axis of the crank pin 8 and a radially outermost end of the snap ring 31*a* or 31*b*. Of course, the radius R1 is determined smaller than the radius R2 of the second imaginary circle C2 which represents the distance the axis of the crank pin 8 and the radially innermost end "RIE" of each of the projected inner surfaces 19*a* and 19*b*, as shown.

Accordingly, as is seen from FIGS. 10 and 11, the first and second forked portions 21 and 22 are suppressed from interfering with the paired counterweights 16*a* and 16*b* upon swinging of the lower link 9 about the crank pin 8 even though the forked portions 21 and 22 carry the projected connecting pins 7 and 10. Usage of the snap rings 31*a* and 31*b* facilitates a work for assembling the link mechanism.

Figure 12A:
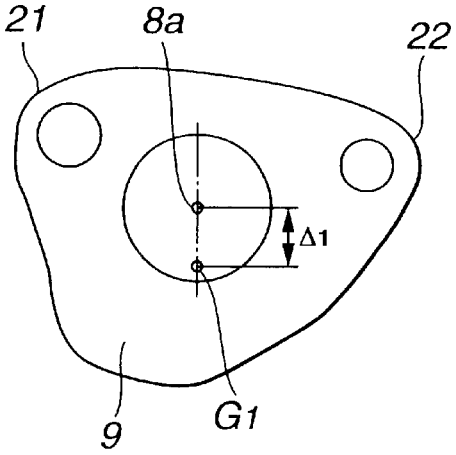
FIG. 12A is a view of the lower link in a naked state.
Figure 12B:
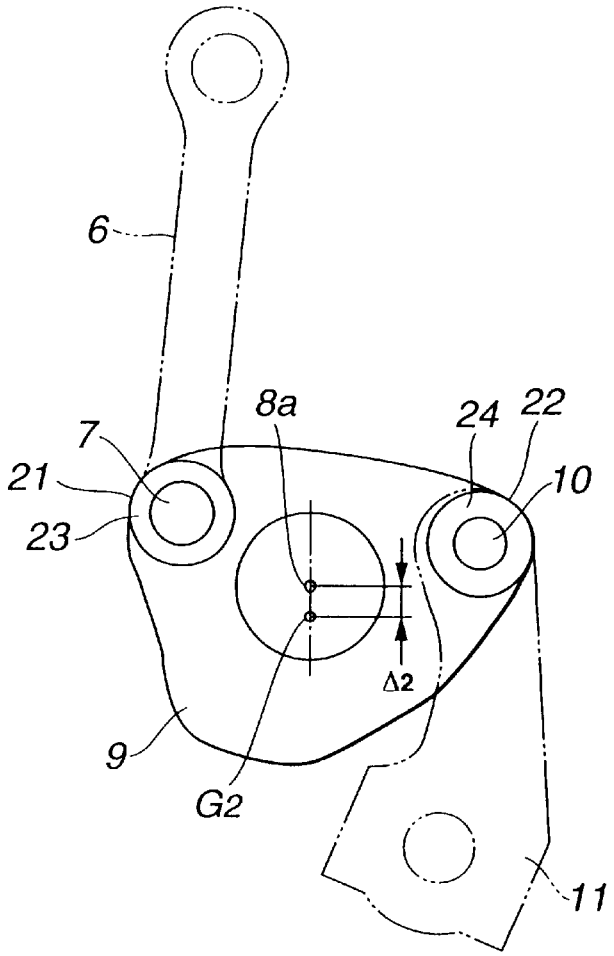
FIG. 12B is a view of the lower link in an assembled state.

In the following, a center of gravity of the lower link 9, which should be established when the crank mechanism is assembled, will be described with reference to FIGS. 12A and 12B. FIG. 12A shows the lower link 9 in a naked state. In this naked state, the lower link 9 has a center of gravity at point G1. As shown, the center of gravity G1 is positioned away from the axis 8*a* of the crank pin 8 by a distance Δ1 in a direction opposite to the first and second forked portions 21 and 22 with respect to the crank pin 8. FIG. 12B shows the lower link 9 in an assembled state wherein the upper link 6 and the control link 11 are pivotally connected to the first and second forked portions 21 and 22 of the lower link 9 through the first and second connecting pins 7 and 10 in the above-mentioned manner. That is, in this assembled state, the center of gravity of the lower link 6 is shifted to point G2 because equivalent mass of the lower end of the upper link 6, equivalent mass of the upper end of the control link 11 and mass of the first and second connecting pins 7 and 10 are all added to a mass of the lower link 9. As shown, in the assembled state, the center of gravity G2 is positioned away from the axis 8*a* of the crank pin 8 by a distance Δ2. In the present invention, the distance Δ2 is determined smaller than the distance Δ1. For achieving an ideal swinging of the lower link 9 about the crank pin 8, the center of gravity G2 is to be placed on the axis 8*a* of the crank pin 8. In this case, high frequency vibration caused by the swinging of the lower link 9 is effectively damped.

Figure 13:
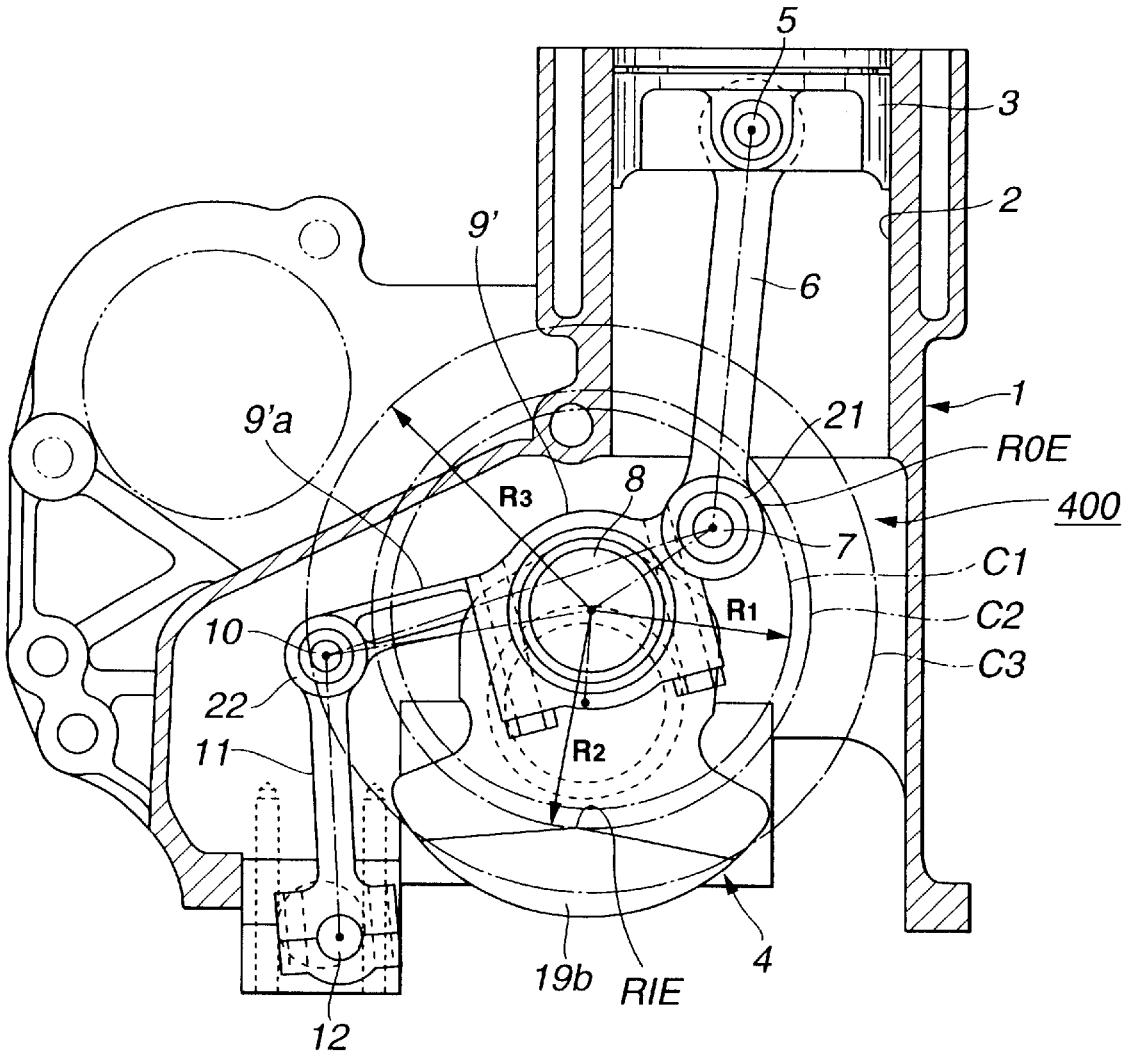
FIG. 13 is a sectional view of an internal combustion engine to which a crank mechanism of a fourth embodiment of the present invention is practically applied.

Referring to FIG. 13, there is shown a crank mechanism 400 of a fourth embodiment of the present invention.

As is seen from this drawing, the lower link 9' employed in this fourth embodiment 400 is different in shape from the lower link 9 used in the above-mentioned first, second and third embodiments 100, 200 and 300. That is, the lower link 9' swingably disposed on the crank pin 8 comprises a first forked portion 21 to which a lower end of the upper link 6 is pivotally connected through the first connecting pin 7 and a second forked portion 22 to which an upper end of the control link 11 is pivotally connected through the second connecting pin 10. However, the second forked portion 22 is formed on a leading end of an arm 9'a extending from a major portion of the lower link 9'. This unique shape of the lower link 9' is thought out by taking a load balance between the first and second forked portions 21 and 21 into consideration. That is, as is shown in the drawing, if a distance between the axis of the crank pin 8 and the axis of the second connecting pin 10 on the second forked portion 22 is set longer than that between the axis of the crank pin 8 and the axis of the first connecting pin 7 on the first forked portion 21, a load applied to the second connecting pin 10 becomes smaller than that applied to the first connecting pin 7. Thus, in this case, the size, more specifically, the axial dimension of the second forked portion 22 can be reduced. This means that, as will be understood from FIG. 11, the second forked portion 22 (illustrated by broke lines) is arranged within the clearance defined between the projected inner surfaces 19*a* and 19*b* of the counterweights 16*a* and 16*b*.

Accordingly, as is seen from FIGS. 13 and 11, the first and second forked portions 21 and 22 are suppressed from interfering with the paired counterweights 16*a* and 16*b* upon swinging of the lower link 9' about the crank pin 8 even though the second forked portion 22 extends radially beyond the circle C2 which is described by the radially innermost end "RIE" of the projected inner surface 19*a* or 19*b*.

In FIG. 13, the radius R1 of the first imaginary circle Cl represents the distance between the axis of the crank pin 8 and the radially outermost end "ROE" of the first forked portion 21, the radius R2 of the second imaginary circle C2 represents the distance between the axis of the crank pin 8 and the radially innermost end "RIE" of the projected inner surface 19*a* or 19*b*. Denoted by reference C3 is a third imaginary circle which would be described by a radially outermost end of the second of the second forked portion 22 if the lower link 9' turns about the axis of the crank pin 8. That is, a radius R3 of the third imaginary circle C3 represents the distance between the axis of the crank pin 8 and the radially outermost end of the second forked portion 22. As shown, the third imaginary circle C3 is larger than the second imaginary circle C2, and the second imaginary circle C2 is larger than the first imaginary circle Cl in the fourth embodiment 400.

The above-mentioned four embodiments 100, 200, 300 and 400 are described as being incorporated with a link mechanism of a so-called double-link type including only the upper link 6 and the control link 11. However, if desired, the present invention is applicable to a link mechanism of a multi-link type including at least three links.

Figure 14:
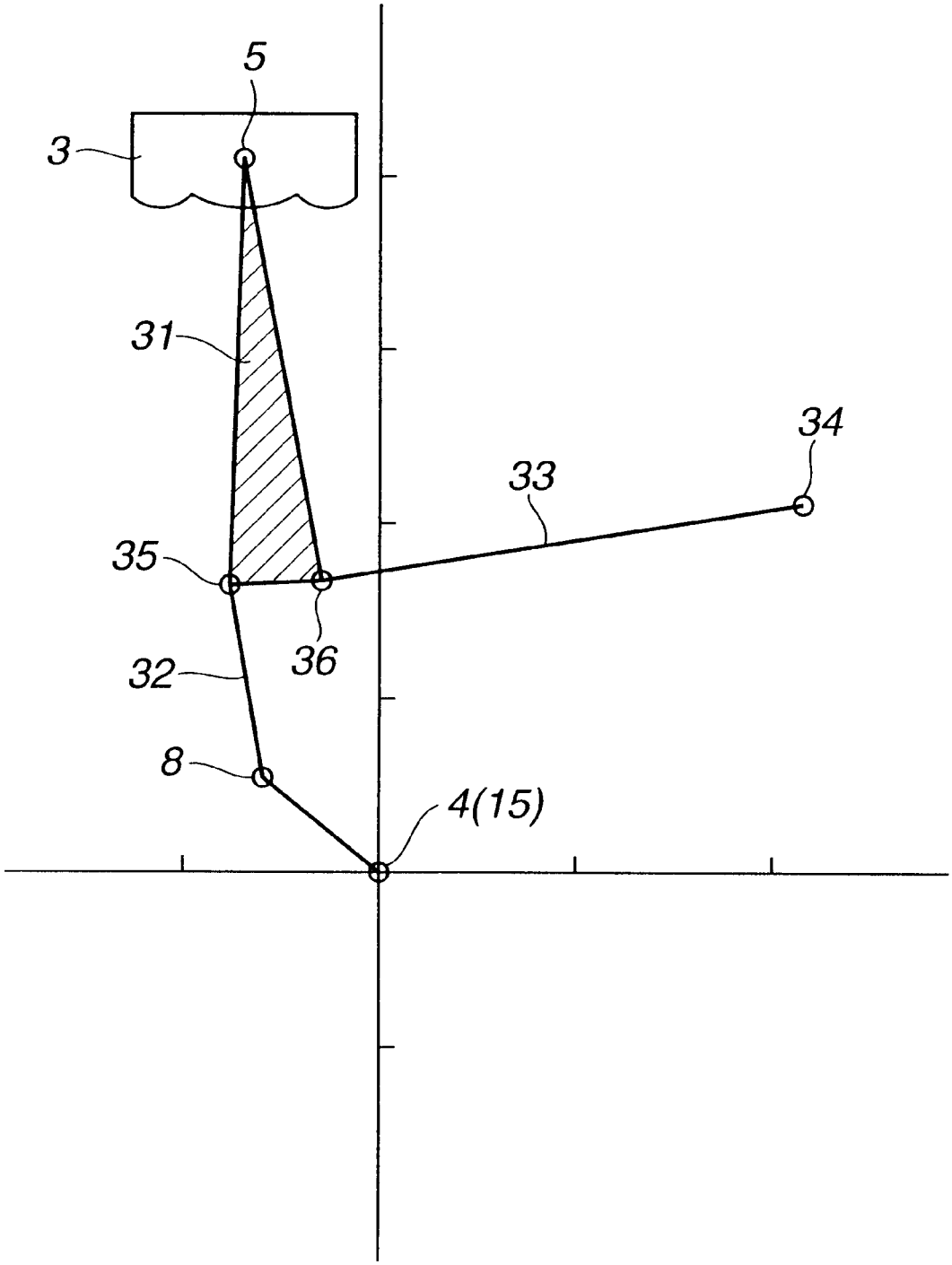
FIG. 14 is a schematic view of a link mechanism having three links.

FIG. 14 shows schematically a link mechanism of multi-link type to which the invention is applicable. In this mechanism, a first link 31 extends from the piston pin 5 of the piston 3. The first link 31 is provided with first and second connecting portions 35 and 36. A second link 32 extends from the first connecting portion 35 to the crank pin 8 of the crankshaft 4. A third link 33 extends from the second connecting portion 36 to a swingably supporting portion 34 of the engine. In this link mechanism, three links 31, 32 and 33 are employed. Small circles shown in this drawing represent pivotal structures incorporated with the links 31, 32 and 33.

Figure 15:
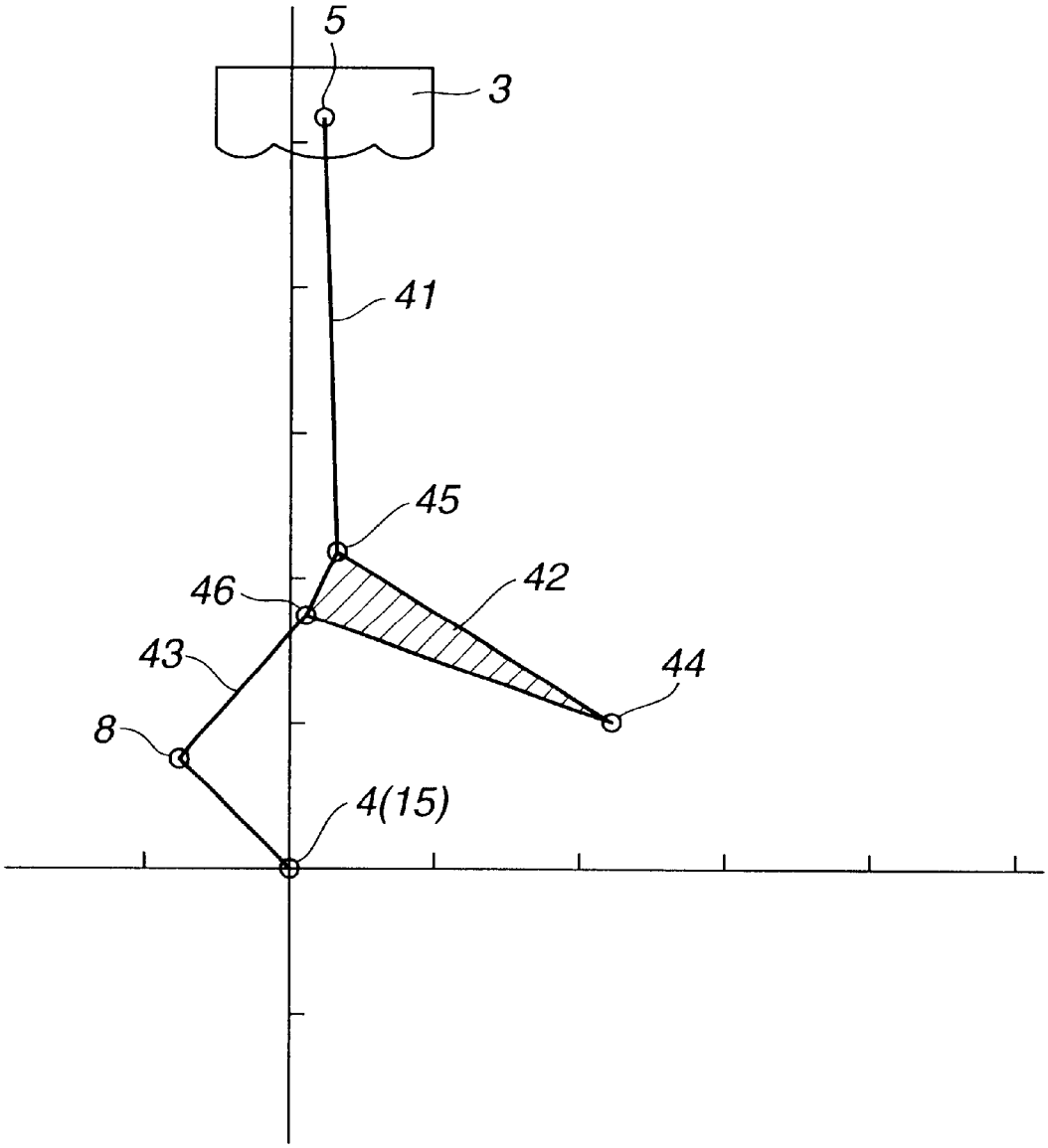
FIG. 15 is a view similar to FIG. 14, but showing another link mechanism having three links.
Figure 16:
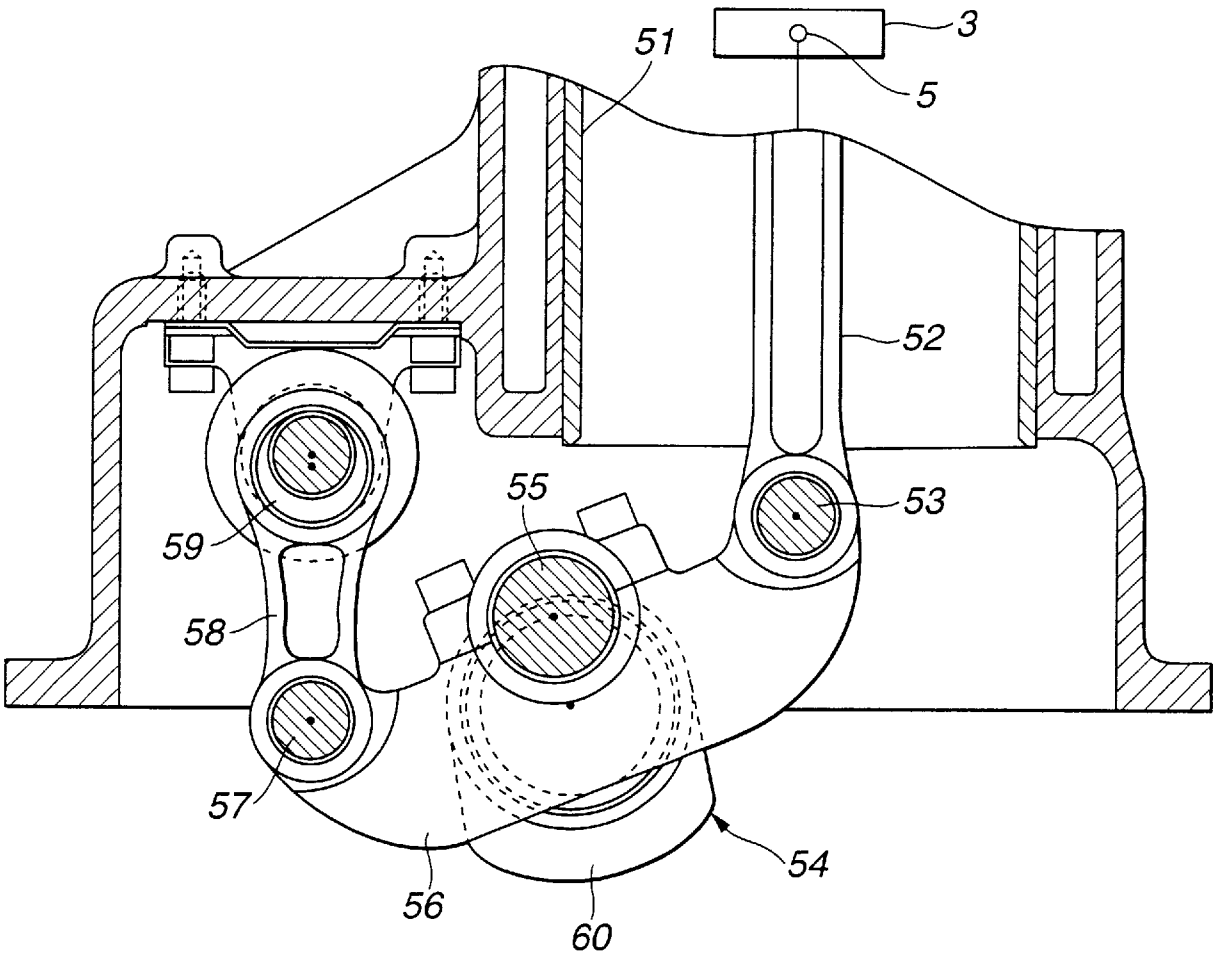
FIG.16 (RELATED ART)
FIG. 16 is a sectional view of a lower part of an internal combustion engine to which a known crank mechanism is applied.

FIG. 15 shows schematically another link mechanism of multi-link type to which the invention is also applicable. In this mechanism, a first link 41 extends from the piston pin 5 of the piston 3. A second link 42 is swingably supported at one portion 44 by the engine. The second link 42 link 42 is provided with first and second connecting portions 45 and 46. The first portion 45 is connected to the other end of the first link 41. A third link 43 extends from the second connecting portion 46 to the crank pin 8 of the crankshaft 4. Also in this link mechanism, three links 41, 42 and 43 are employed.

The entire contents of Japanese Patent Application 2000-381435 (filed Dec. 15, 2000) are incorporated herein by reference.

Although the invention has been described above with reference to the embodiments of the invention, the invention is not limited to such embodiments as described above. Various modifications and variations of such embodiments may be carried out by those skilled in the art, in light of the above descriptions.

What is claimed is:

1. A crank mechanism of a reciprocating internal combustion engine having a piston, comprising:

a crankshaft including paired crank webs with first end portions connected through a crank pin, and paired counterweights integral with second end portions of the paired crank webs, said paired counterweights having projected inner surfaces which protrude toward each other defining a given space therebetween;

a link mechanism including a plurality of links between the piston and the crankshaft which are arranged to convert a reciprocating motion of said piston to a rotational motion of the crankshaft, a given one of said links being pivotally connected to other links through link connecting portions and swingably disposed on said crank pin so that upon rotation of said crankshaft, a peripheral portion of said given link passes through said given space, wherein at least one of said link connecting portions is placed within an imaginary circle which would be described as being centered about an axis of said crank pin and having a radius substantially equal to the distance between the radially innermost part of said projected inner surfaces of the paired counterweights and the center of said crank pin.

2. A crank mechanism as claimed in claim 1, in which all of said link connecting portions are placed within said imaginary circle.

3. A crank mechanism as claimed in claim 1, in which said link mechanism comprises:

an upper link having one end pivotally connected to said piston;

a lower link having first and second link connecting portions, said first link connecting portion being pivotally connected through a first connecting pin to the other end of said upper link, said lower link being said given link; and a control link having one end pivotally connected to said second link connecting portion through a second connecting pin and the other end swingably supported by a base member of the engine.

4. A crank mechanism as claimed in claim 3, in which said lower link is wholly received in said imaginary circle.

5. A crank mechanism as claimed in claim 3, in which said first link connecting portion comprises two spaced support arms by which said first connecting pin is held, the other end of said upper link being pivotally held by said first connecting pin, in which said second link connecting portion comprises two spaced support arms by which said second connecting pin is held, the one end of said control link being pivotally held by said second connecting pin, and in which at least one of said first and second link connecting portions has an axial dimension which is greater than a distance between said projected inner surfaces of the paired counterweights and said at least one of said first and second link connecting portions is placed within said imaginary circle.

6. A crank mechanism as claimed in claim 5, in which said first link connecting portion is placed within said imaginary circle, and in which said second link connecting portion has an axial dimension which is smaller than the distance between said projected inner surfaces of the paired counterweights and extends across said imaginary circle.

7. A crank mechanism as claimed in claim 6, in which said first link connecting portion has an axial dimension which is greater than a thickness of a major central portion of the lower link where said crank pin passes.

8. A crank mechanism as claimed in claim 3, in which at least one of said first and second connecting pins has axially opposed ends projected outward from the corresponding link connecting portion, in which said at least one of said first and second connecting pins is placed within said imaginary circle and in which a peripheral part of said lower link extends across said imaginary circle.

9. A crank mechanism as claimed in claim 8, in which the projected opposed ends of the connecting pin are equipped with snap rings for holding the connecting pin in place.

10. A crank mechanism as claimed in claim 3, in which the other end of said control link is connected to a control mechanism by which the position of said control link is changed thereby to change a top dead center of said piston.

11. A crank mechanism as claimed in claim 3, in which a distance between the axis of crank pin and a first center of gravity of the lower link established when the lower link is assembled with the upper and control links is smaller than a distance between the axis of the crank pin and a second center of gravity established when the lower link is in a naked state.

12. A crank mechanism as claimed in claim 1, in which a distance between the projected inner surfaces of the paired counterweights is smaller than a distance between mutually facing surfaces of the first end portions of the paired crank webs.

13. A crank mechanism as claimed in claim 1, in which the paired crank webs are formed at middle portions thereof with respective recesses which face each other, each recess extending in a direction perpendicular to an axis of said crankshaft.

14. A crank mechanism as claimed in claim 13, in which each of the recesses comprises:

a curved upper wall which curves upward; and a lower wall including two inclined straight walls which are joined at said radially innermost part, each straight wall going downward as a distance from said radially innermost part increases.

15. A crank mechanism as claimed in claim 1, in which when a stroke of the piston is denoted by "L" and a revolution radius of the crank pin 8 is denoted by "r", an inequality "$L/2r>1$" is established.

16. A crank mechanism of a reciprocating internal combustion engine having a piston, comprising:

a crankshaft including paired crank webs with first end portions connected through a crank pin, and paired counterweights integral with second end portions of the paired crank webs, said paired crank webs having mutually facing surfaces which define therebetween a given space;

a link mechanism including a plurality of links between the piston and the crankshaft which are arranged to convert a reciprocating motion of said piston to a rotational motion of the crankshaft, a given one of said links being pivotally connected to other links through link connecting portions and swingably disposed on said crank pin so that upon rotation of said crankshaft, a peripheral portion of said given link passes through said given space; and recesses respectively formed in the mutually facing surfaces of said paired crank webs, said recesses being positioned and sized to permit at least one of said link connecting portions to pass therebetween upon swinging of said given link about an axis of said crank pin.

17. A crank mechanism as claimed in claim 16, in which all of said link connecting portions are arranged to pass between said recesses upon swinging of said given link about the axis of said crank pin.

18. A crank mechanism as claimed in claim 17, in which each of the link connecting portions has an axial dimension which is smaller than a length between respective bottom surfaces of said recesses and longer than a length between mutually facing surfaces of the paired counterweights.

19. A crank mechanism as claimed in claim 16, in which another one of said link connecting portions is sized and arranged to pass through a space between mutually facing surfaces of said paired counterweights upon swinging of said given link about the axis of said crank pin.

20. A crank mechanism as claimed in claim 16, in which another one of said link connecting portions is sized and arranged to travel on a traveling way of said paired counterweights upon swinging of said given link about the axis of said crank pin.

* * * * *